US008099293B2

(12) United States Patent
Kulkarni

(10) Patent No.: US 8,099,293 B2
(45) Date of Patent: Jan. 17, 2012

(54) AUDIO SIGNAL PROCESSING

(75) Inventor: Abhijit Kulkarni, Thousand Oaks, CA (US)

(73) Assignee: Bose Corporation, Framingham, MA (US)

( * ) Notice: Subject to any disclaimer, the term of this patent is extended or adjusted under 35 U.S.C. 154(b) by 310 days.

(21) Appl. No.: 12/190,653

(22) Filed: Aug. 13, 2008

(65) Prior Publication Data

US 2008/0304671 A1 Dec. 11, 2008

Related U.S. Application Data

(62) Division of application No. 10/863,931, filed on Jun. 8, 2004, now Pat. No. 7,490,044.

(51) Int. Cl.
*G10L 19/00* (2006.01)

(52) U.S. Cl. ..... 704/501; 704/500; 704/504

(58) Field of Classification Search ..... 704/500–504, 704/229, 220, 200.1, 200, 221
See application file for complete search history.

(56) References Cited

U.S. PATENT DOCUMENTS

| | | | | |
|---|---|---|---|---|
| 4,024,344 | A | 5/1977 | Dolby et al. | |
| 4,920,569 | A | 4/1990 | Yoshio et al. | |
| 4,968,154 | A | 11/1990 | Baeg et al. | |
| 5,046,098 | A | 9/1991 | Mandell et al. | |
| 5,528,694 | A | 6/1996 | Van De Kerkhof et al. | |
| 5,854,847 | A | 12/1998 | Yoshida et al. | |
| 5,890,125 | A * | 3/1999 | Davis et al. | 704/501 |
| 6,253,185 | B1 * | 6/2001 | Arean et al. | 704/500 |
| 6,496,584 | B2 | 12/2002 | Irwan et al. | |
| 6,778,953 | B1 * | 8/2004 | Edler et al. | 704/200.1 |
| 7,277,849 | B2 * | 10/2007 | Streich et al. | 704/229 |
| 7,343,291 | B2 * | 3/2008 | Thumpudi et al. | 704/500 |
| 7,630,500 | B1 | 12/2009 | Beckman et al. | |
| 2002/0071574 | A1 | 6/2002 | Aylward et al. | |
| 2004/0105559 | A1 | 6/2004 | Aylward et al. | |

FOREIGN PATENT DOCUMENTS

| | | | |
|---|---|---|---|
| JP | 58187100 | A | 11/1983 |
| JP | 06-500898 | | 1/1994 |
| JP | 06-125600 | A | 5/1994 |
| JP | 06-506092 | | 7/1994 |
| JP | 09006376 | A | 1/1997 |
| JP | 2001514808 | T | 9/2001 |
| JP | 2002078100 | A | 3/2002 |
| JP | 2002341865 | A | 11/2002 |
| JP | 2003274492 | A | 9/2003 |
| WO | 01/62045 | A1 | 8/2001 |

OTHER PUBLICATIONS

JP Office Action dated Jun. 15, 2010 for JP Appln. No. 2005-167517.
EP Search Report dated Jun. 24, 2008 for European Application No. 05104362.8.
Chinese Office Action dated Sep. 25, 2009 for CN 200510076162.4.
JP Notice of Allowance dated Mar. 29. 2011 for JP 2005-167517.
IN First Examination Report dated Oct. 10, 2011 for Indian Application no.: 1168/DEL/2005.

* cited by examiner

*Primary Examiner* — Huyen X. Vo

(57) ABSTRACT

An audio system for processing two channels of audio input to provide more than two output channels. The input may be conventional stereo material or compressed audio signal data. The audio processing includes separating the input signals into frequency bands and processing the frequency bands according to processes which may differ from band to band. The audio processing includes no processing of L–R signals.

3 Claims, 8 Drawing Sheets correlated, in phase
1.0
0.5
0
1.0
0.5
- 20 dB
- 10 dB
0
10 dB
20 dB
center
left
left surround
right
right surround uncorrelated/phase quadrature
1.0
0.5
0
1.0
0.5
- 20 dB
- 10 dB
0
10 dB
20 dB
center
left
left surround
right
right surround correlated, out of phase
1.0
0.5
0
1.0
0.5
- 20 dB
- 10 dB
0
10 dB
20 dB
center
left
left surround
right
right surround correlated, in phase 1.0
0.5
0
– 20 dB
– 10 dB
0
10 dB
20 dB
center
left
left surround
right
right surround uncorrelated/phase quadrature 1.0
0.5
0
– 20 dB
– 10 dB
0
10 dB
20 dB
center
left
left surround
right
right surround correlated, out of phase 1.0
0.5
0
– 20 dB
– 10 dB
0
10 dB
20 dB
center
left
left surround
right
right surround

AUDIO SIGNAL PROCESSING

CLAIM OF PRIORITY

This application is a divisional application of, and claims priority of, U.S. patent application Ser. No. 10/863,931, filed on Jun. 8, 2004, the entire contents of which is hereby incorporated by reference in its entirety.

BACKGROUND OF THE INVENTION

The invention pertains to audio signal processing and more generally to methods for processing two channel audio signals to create more than two output channels.

SUMMARY OF THE INVENTION

In one aspect of the invention, a method for processing two input audio channel signals to provide n output audio channel signals where n>2, includes dividing the first input channel signal and the second input channel signal into a plurality of corresponding non-bass frequency bands; measuring the amplitude of the audio signal in the two input channels in one the frequency bands to provide a first channel first frequency band audio signal and a second channel first frequency band audio signal to provide a first channel first frequency band audio signal amplitude and a second channel first frequency band audio signal amplitude; determining the correlation between the first channel first frequency band audio signal and the second channel first frequency band audio signal to provide a first frequency band correlation; scaling the first channel first frequency band audio signal by a first factor (a(first)) related to the first frequency band correlation and further related to the first channel first frequency band audio signal amplitude and the second channel first frequency band audio signal amplitude, the scaling to provide a first scaled first output channel first frequency band audio signal first portion; scaling the second channel first frequency band audio signal by a second factor (a(second) related to the first frequency band correlation and further related to the first channel first frequency band audio signal amplitude and the second channel first frequency band audio signal amplitude, the scaling to provide a first scaled first output channel first frequency band audio signal second portion; combining the first scaled first channel first frequency band audio signal first portion and the first scaled first channel first frequency band audio signal first portion to provide a first frequency band portion of a center channel output audio signal. The method may further include scaling the first channel first frequency band audio signal by a third factor, which may be $=\sqrt{1-\alpha(\text{first})^2}$ to provide a first frequency band portion of a left channel output signal. The method may further include combining the first frequency band portion of the left channel output audio signal with a second frequency band portion of the first channel audio signal to provide a left non-bass audio signal. The frequency bands may be time varying. The first frequency band may be the speech band. The two input audio channel signals comprise compressed audio signal data. The compressed audio signals may be in a non-reconstructable data format, which may be the MP3 format.

In another aspect of the invention, a method for processing two input audio channel signals to provide n output audio channel signals wherein n>3 and wherein the n output channel signals include surround channels includes separating the two input channels into a plurality of corresponding non-bass frequency bands; processing each of the plurality of input channel non-bass frequency bands to provide the corresponding frequency band of a center channel output signal and two non-surround non-center output channel signals; processing at least one of the two non-center non-surround output channel signals to provide a surround output channel signal, wherein the processing the two non-center channel output signals does not include processing a signal representing the difference between the two input channels. The processing the two non-center channel output signals comprises at least one of time delaying, attenuating, and phase shifting one of the two non-center input channel signals.

In another aspect of the invention, a method for processing two input audio channels to provide n output audio channels where n>2, includes dividing the first input channel signal and the second input channel signal into a plurality of corresponding non-bass frequency bands; processing according to a first process a first input channel first frequency band audio signal to provide a first portion of a first frequency band of a center output channel signal; processing according to a second process a input channel first frequency band audio signal to provide a second portion of the first frequency band of the center output channel signal; processing according to a third process a first input channel second frequency band audio signal to provide a first portion of a second frequency band of the center output channel signal; and processing according to a fourth process a second input channel second frequency band audio signal to provide a second portion of the second frequency band of the center output channel signal; wherein the third process is different from the first process and the second process and wherein the fourth process is different from the first process and the second process. The method may further include processing according to a fifth process the first input channel first frequency band audio signal to provide a first portion of a first frequency band of a non-center output channel signal; and processing according to a sixth process the first input channel second frequency band audio signal to provide a first portion of a second frequency band of the non-center output channel signal; wherein the fifth process is different from the sixth process. The first process may include scaling the first input channel first frequency band audio signal by a factor a. The fifth process comprises scaling the first input channel first frequency band audio signal by a factor $\sqrt{1-a^2}$. The sixth process may include providing the unattenuated first input channel second frequency band audio signal so that the center output channel signal comprises the first input channel first frequency band audio signal scaled by a and so that the non-center output channel comprises the first input channel first frequency band signal scaled by $\sqrt{1-a^2}$ and the unattenuated first input channel second frequency band signal. The third process may include providing none of the first input channel second frequency band audio signal to provide a first portion of a second frequency band of the center output channel signal so that the center output channel signal comprises the first input channel first frequency band audio signal scaled by a and no portion of the first input channel second frequency band audio signal. The sixth process may include providing the unattenuated first input channel first frequency band audio signal. At least one of the first process, the second process, the third process, or the fourth process may be time varying.

In still another aspect of the invention, a method for processing two input audio channel signals to provide n output audio channel signals wherein n>2 and wherein the two input audio channel signals comprise unreconstructable compressed audio signal data, the method includes separating the input audio channel signals into frequency bands; separately processing the frequency bands; and combining the separately processed frequency bands to provide the n output audio channels. The separately processing the frequency may include scaling a first channel first frequency band signal, scaling a second channels first frequency band signal, and wherein the separately processing does not include processing a signal representing the difference between any portions of the first input audio channel signal and the second audio channel signal.

Other features, objects, and advantages will become apparent from the following detailed description, when read in connection with the following drawing, in which:

DETAILED DESCRIPTION

Figure 1A:
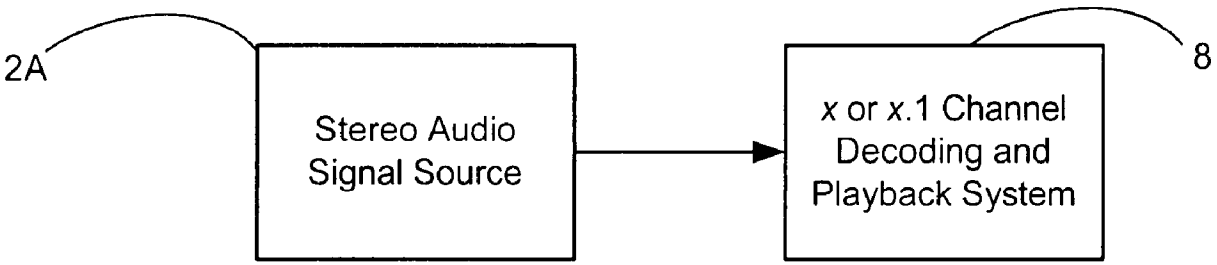
FIGS. 1A and 1B are block views of audio systems.

Though the elements of several views of the drawing are shown and described as discrete elements in a block diagram and are referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Unless otherwise indicated, signal lines may be implemented as discrete analog or digital signal lines, as a single discrete digital signal line with appropriate signal processing to process separate streams of audio signals, or as elements of a wireless communication system. Some of the processing operations are expressed in terms of the calculation and application of coefficients. The equivalent of calculating and applying coefficients can be performed by other signal processing techniques and are included within the scope of this patent application. Unless otherwise indicated, audio signals may be encoded in either digital or analog form.

Figure 1B:
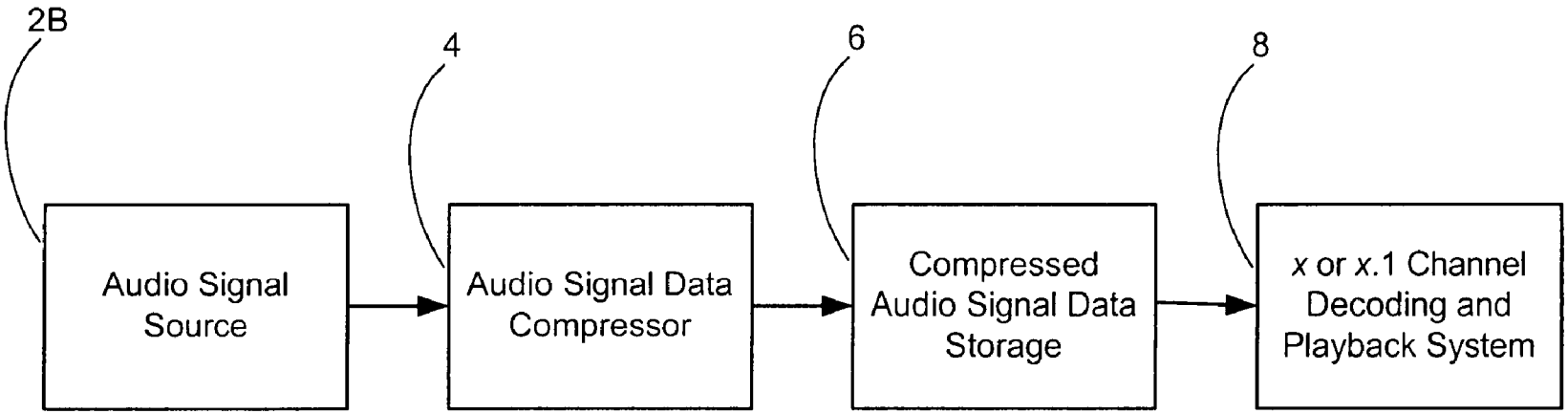

Referring to FIGS. 1A and 1B, there are shown two audio systems. In FIG. 1A, a stereo audio signal source 2A is coupled to an x or x.1 channel decoding and playback system 8. The decoding and playback system 8 has a plurality x of audio channels, including a center channel and at least one surround channel. Typically x is 4 or 5, but may be more. The decoding and playback system may also have a low frequency effects (LFE) channel, as indicated by the "0.1". The decoding and playback system 8 receives stereo audio signals from the stereo audio signal source 2A and processes the stereo audio signals in a manner to be described below to provide the x channels.

Many decoding and playback systems that process stereo audio signals to provide additional channels introduce undesirable acoustic effects into one or more of the channels of the x or x.1 channel playback. Some decoding and playback systems may separate and process an L−R signal to create the surround channels. An "L−R signal" refers to a signal that is the difference between the L (left channel) signal and the corresponding R (right channel) signal. In some instances, a difference between an L and an R signal, present in material created for stereo reproduction, may result from an acoustic effect desired by a content creator which was not intended to be radiated from surround speakers. In some conventional surround audio systems, L−R signals are interpreted as intended to be radiated by surround speakers. If L−R signals of a conventionally created stereo recording are interpreted as intended to be radiated by surround speakers, sound that is intended to come from in front of the listener may appear to come from behind the listener. If the L−R signal is used to create the surround speaker signals, vocal sounds may not be well anchored or spatial effects may be altered from what was intended by the content creator, or audible artifacts may appear.

In FIG. 1B, an audio signal data compressor 4 receives audio signal data from an audio signal source 2B and compresses the audio signal data and stores the compressed audio signal data in a compressed audio signal data storage device 6. A decoding and playback system 8 decodes the compressed audio signals, processes the audio signals to provide the x channels, and transduces the decoded audio signals to acoustic energy. The audio signal source 2A may be a conventional stereo device, such as a CD player or may also be stereo radio signals received by an AM or FM radio receiver, an IBOC (in-band on channel) radio receiver, a satellite radio receiver, or an internet device. The audio signal source 2B may likewise be a conventional stereo device such as a CD player, but may also be a multi-channel audio source. The audio signal data compressor 4 may be one of many types of audio signal data compressors that (if necessary downmix the multi-channels to two channels and) compress audio signal data so that the audio signal data can be transmitted more quickly and with less bandwidth, or stored in significantly less memory, or both, than uncompressed audio signal data. Some compressors compress the data in non-reconstructable or "lossy" manner; that is they compress the signals in a manner such that some information is discarded so that the original signal data cannot be exactly recreated by the decoding and playback system 8. One class of such devices uses the so-called MP3 compression algorithm. Compressors using the MP3 algorithm typically store the audio signal on a storage device 6 such as a hard disk; the stored audio signal may then be copied to another storage device such as a hard disk on a portable MP3 player or may be decoded and transduced by a decoding and playback system 8. Since lossy compressors may discard data, the audio signal stored on the storage device may have undesirable artifacts that can be transduced into acoustic energy. The compression algorithm may therefore be configured so that the artifacts are masked and are therefore substantially inaudible when played on a conventional stereo system.

Many algorithms, such as the MP3 algorithm, are designed to provide two channel (typically stereo L and R) audio signals to the storage device. When the compressed audio signals are decoded and transduced by a stereo playback device, artifacts resulting from the discarding of data are substantially inaudible due to masking, as stated above. Some playback systems, however, have more than two channels, for example in addition to the left and right channels, a center channel and one or more surround channels. Some of these multichannel playback systems have signal processing circuitry that processes the two channels to provide additional channels, such as a center channel and one or more surround channels. Sometimes, however, the processing of the two channels to provide additional channels causes the artifacts created by the discarding of data to become unmasked so that they are audible and annoying.

One example of how the processing of the two channels to provide additional channels can cause the unmasking of artifacts is when a difference operation (i.e. generating an L−R signal) is used to create the additional channels. In audio signals compressed by algorithms such as the MP3 algorithm, the difference signal of the de-compressed L and R signals (i.e. signals that are the result of passing through a lossy compression and de-compression process) may not be representative of the difference between the uncompressed L and R input signals. Instead, a significant portion of the difference between the de-compressed L and the R signals may be artifacts resulting from the discarding of data by the compression algorithm. Some of the content that was common to the de-compressed L and R signal may have been necessary to mask artifacts. If this common content is removed by a difference operation (i.e. creating a signal that is the difference of the de-compressed L and R signals), the artifacts may become unmasked and therefore audible. Stated differently, the de-compressed L and R signals each contain artifacts, but the signal to artifact ratio (analogous to a signal to noise ratio) is sufficiently high that the artifacts are not audible. Extracting the common content by performing a difference operation on the de-compressed signals may remove significant signal content, so the signal to artifact ratio is significantly lower and the artifacts are audible.

Figure 2:
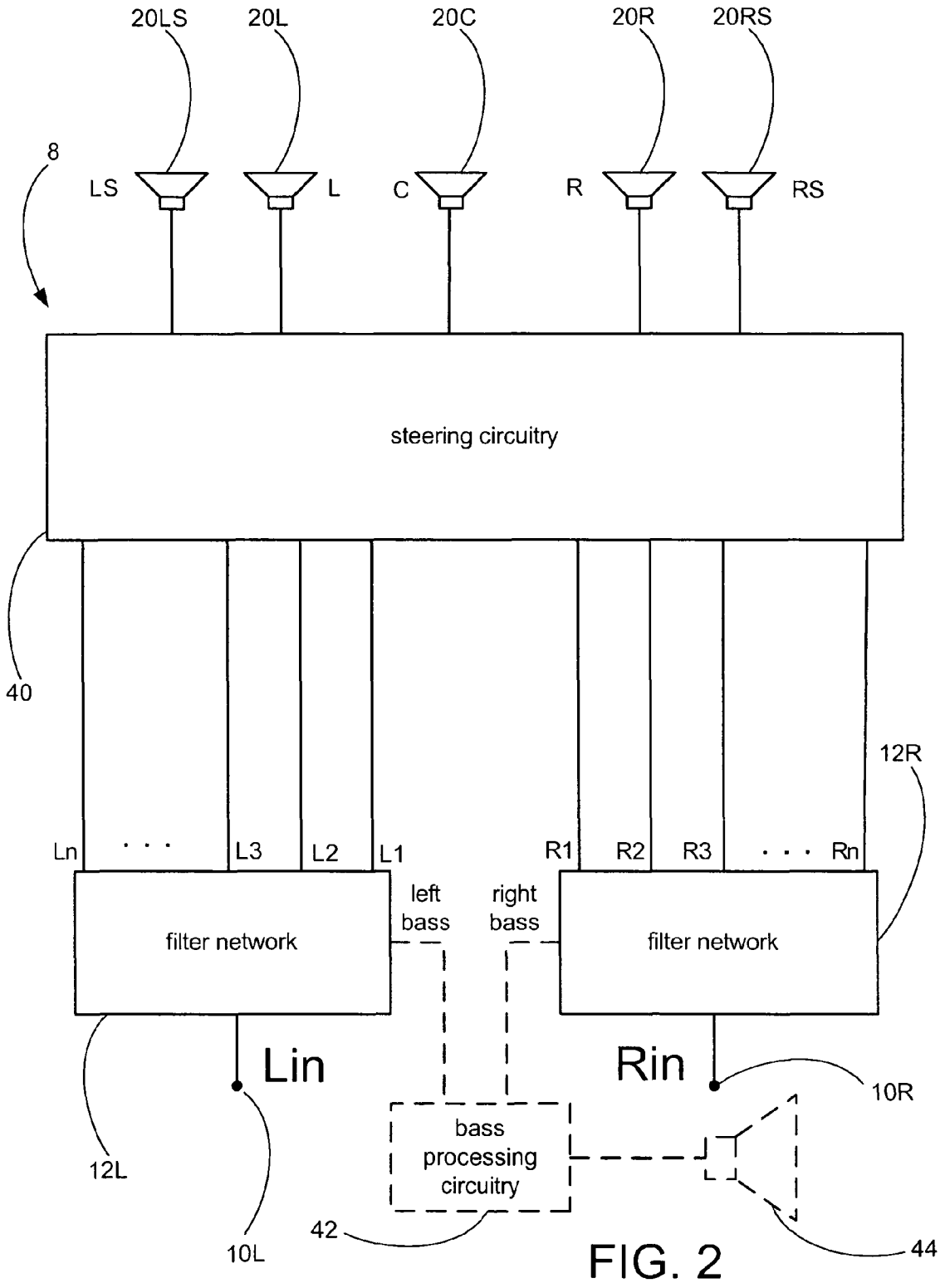
FIG. 2 is a block diagram of a decoding and playback system.

Referring to FIG. 2, there is shown a decoding and playback system 8. The decoding and playback system 8 includes two input terminals 10L and 10R, each communicatingly coupled to a filter network 12L and 12R, respectively. The filter networks 12L and 12R are coupled to steering circuitry 40 by n signal lines designated L1-Ln and R1-Rn, respectively. Steering circuitry 40 is coupled to loudspeakers 20L (left), 20LS (left surround), 20C, (center), 20R (right) and 20RS (right surround). Loudspeakers 20L, 20LS, 20C, 20R, and 20RS collectively may be referred to as loudspeakers 20 below. The filter networks 12L and 12R may also be coupled to bass processing circuitry 42, which may be coupled to bass loudspeaker 44. Some elements, such as amplifiers and digital to analog converters, that are typically present in audio systems, are not shown in this view.

In operation, a channel (such as a left channel) of an audio signal stream (which may be a stream of compressed audio signals, a stream of broadcast audio signal, a stream of conventional stereo signals, etc.) is received at terminal 10L and split by filter network 12L into it frequency bands. The filter network 12L may also separate a bass frequency band. A second channel (such as a right channel) of an audio signal is received at terminal 10R and split by filter network 12R into n frequency bands. The filter network 12R may also separate a bass frequency band.

Steering circuitry 40 processes the several frequency bands of the left and right signals and re-combines the frequency bands to form output multi-channel audio signals, which are transmitted to loudspeakers 20 for transduction into acoustic energy. The multiple channels may include surround channels. For simplicity, the audio signal formed by the steering circuitry to be transmitted to the left speaker will be hereinafter referred to as the "left speaker signal." Similarly, the signal to be transmitted to the center speaker will be referred to as the "center speaker signal"; the signal to be transmitted to the right speaker will be referred to as the "right speaker signal"; the signal to be transmitted to the left surround speaker will be referred to as the "left surround speaker signal" and the signal to be transmitted to the right surround speaker will be referred to as the "right surround speaker signal." Steering circuitry 40 may operate on each frequency band by scaling a signal by a scaling factor and routing the scaled signal to an output channel, in some embodiments through a summer that sums signals from several frequency bands to form an output channel signal. The scaling factor may have a range of values, Such as between zero (indicating complete attenuation) and one (unity gain) as in one of the examples below. Alternatively, the scaling factor may have a range other than zero to one or may be expressed in dB. Conventional audio systems may also provide a user with balance or fade controls to allow a user to control the amount of amplification of the signals in individual speakers or in groups of speakers. More specific descriptions of the operation of the steering circuitry 40 will be explained below.

Figure 3:
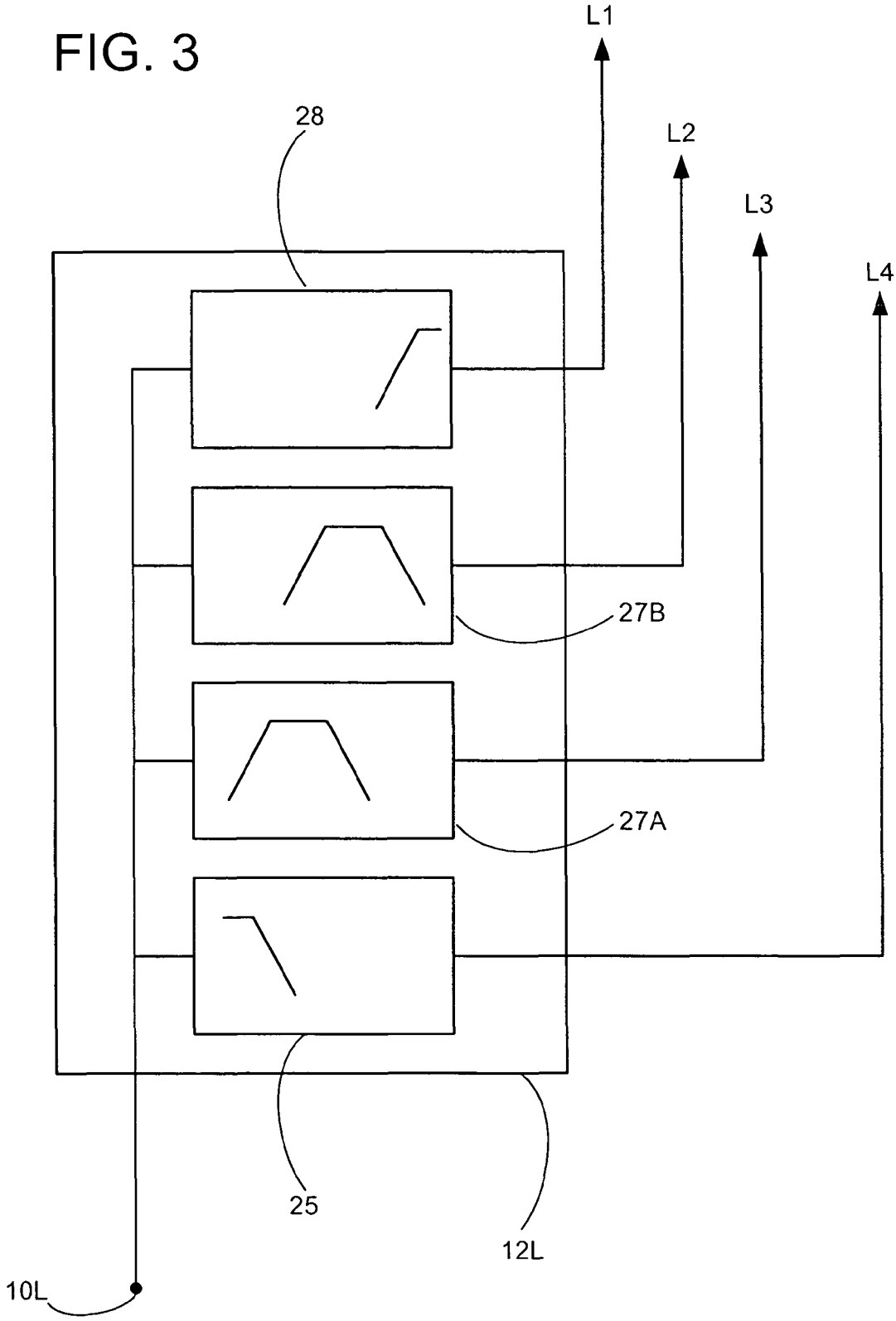
FIG. 3 is a block diagram of a filter network.

Referring now to FIG. 3, there is shown a circuit suitable for filter network 12L or 12R of FIG. 2. Input terminal 10L is coupled in parallel to low pass filter 25, band pass filters 27A and 27B, and high pass filter 28. The output signal of low pass filter 25 is frequency band L1, the output signal of band pass filter 27A is frequency band L2, the output signal of band pass filter 27B is L3, and the output signal of high pass filter 28 is frequency band L4.

The filter networks of FIG. 3 is exemplary only. Many other types of digital or analog filter networks can be employed.

The behavior of the steering circuitry 40 of FIG. 2 can be determined and implemented in a number of ways. The desired behavior can be determined subjectively, for example by listening tests, or objectively for example by a predetermined measurable response to test audio signals, or by a combination of subjective and objective methods. The desired behavior may be implemented by some sort of algebraic equation or set of equations, a look-up table, or by some sort of rules based logic, or by some combination of algebraic equations, look-up table, and rules based logic. The algebraic equation or set of rules may be simple or may be complex; for example the behavior of the steering circuitry applied to one spectral band could be affected by conditions in an adjacent band.

Each of spectral bands (for example band L1/R1, band L2/R2, band L3/R3 etc. of FIG. 2) can be treated differently, and each band can have a different behavior applied to it by the steering circuitry. The behavior of each band can vary over time. The behavior can be expressed in an algebraic equation, where the values of the variables (such as a correlation coefficient, described below) for each frequency band can result in the same algebraic equation resulting in different behavior in different frequency bands. The values of the variables may be time varying, resulting in changing behavior for each band over time and in the behavior of one frequency band differing from the behavior of another frequency band. Additionally, different equations may be used to control the behavior in different bands. The behavior applied by the steering circuitry can include making no modification at all to one or more of the bands, which can be indicated by a scaling factor of one; the behavior can also include significantly attenuating the signal for one or more of the bands, which could be indicated by a scaling factor of zero.

Figure 4:
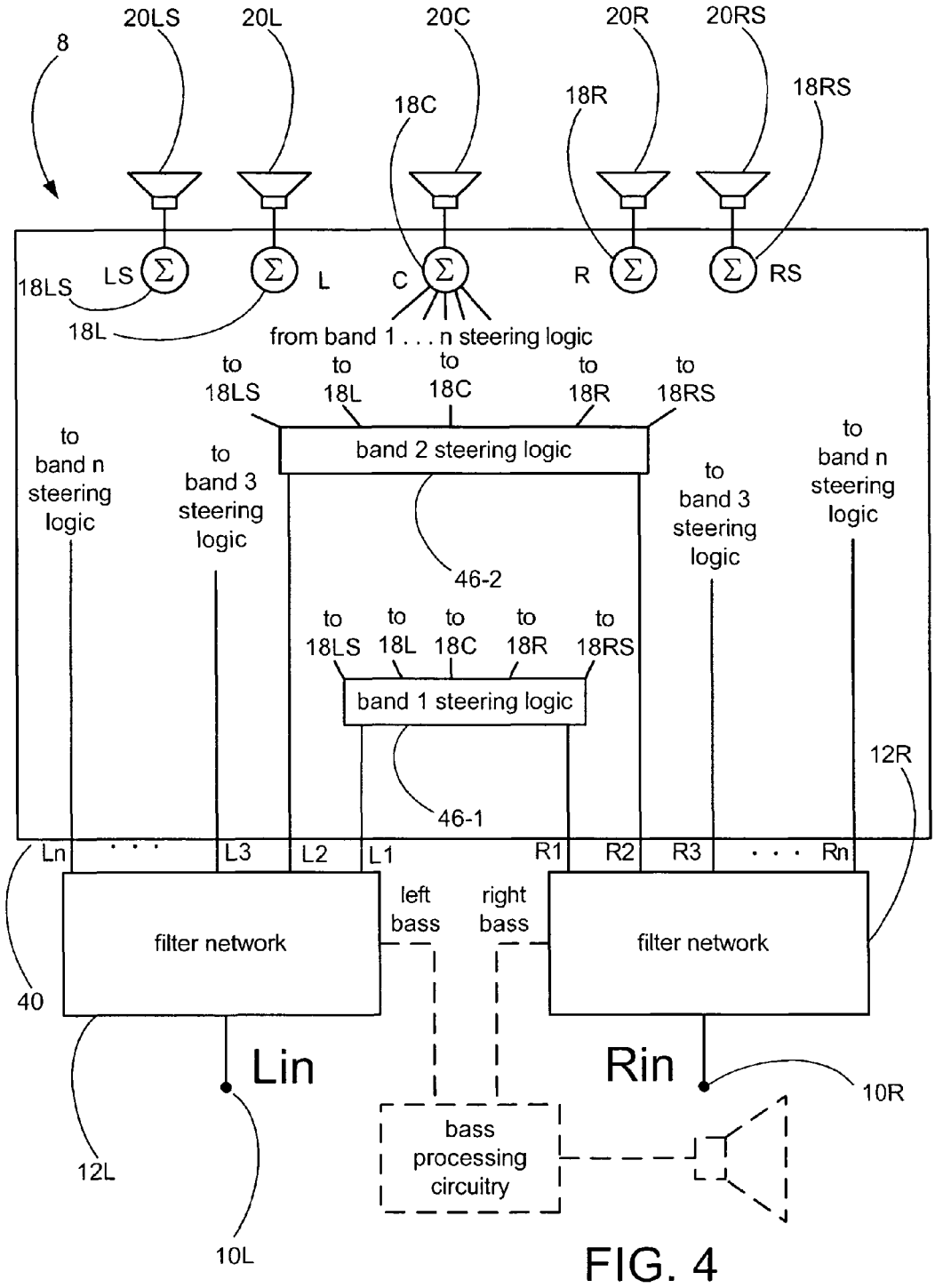
FIG. 4 is a block diagram of an audio system showing steering circuitry in greater detail.

Referring now to FIG. 4, there is shown a decoding and playback system 8, with steering circuitry 40 shown in more detail. The L1 output terminal of filter network 12L and the R1 output of filter network 12R are coupled to band 1 steering logic block 46-1. The L2 output terminal of filter network 12L and the R2 output of filter network 12R are coupled to band 2 steering logic block 46-2. Similarly, each of the output terminals of filter network 12L and a corresponding output terminal of filter network 12R are coupled to a steering logic block. For clarity, only steering logic 46-1 and 46-2 are shown in this view. Each of the steering logic blocks, such as 46-1 and 46-2 are coupled to one or more summers 18LS, 18L, 18C, 18R, and 18RS. For clarity, only signal lines from band 1 and band 2 steering logic blocks 46-1 and 46-2 and signal line to summer 18C are shown. Output signal lines to summers 18LS, 18L, 18C, 18R, and 18RS are shown; however, depending on the steering logic, signal lines to one or more of the summers may be omitted. Input lines from center summer 18C shows inputs from all frequency bands; depending on the steering logic, signal lines form one or more of the steering logic blocks may be omitted. Summers 18LS, 18L, 18C, 18R, and 18RS are coupled to speakers 20LS, 20L, 20C, 20R, and 20RS, respectively. If there is only one signal line to one of the summers, the summer can be omitted and the signal line can couple directly to the speaker.

In operation, a steering logic block such as 46-1 or 46-2 for a frequency band applies logic to the left and right frequency band audio signals. The logic applied by a steering logic block such as 46-1 may differ from the logic applied by steering logic block 46-2 and from the steering logic blocks associated with the other frequency bands. The logic may be in the form of an equation that yields different results for each channel portion of each frequency band, or may be in the form of different equations for each frequency band. Each logic block outputs processed audio signals to one or more of the summers 18LS, 18L, 18C, 18R, and 18RS. The summers 18LS, 18L, 18C, 18R, and 18RS sum the signals from the frequency bands and output audio signals to an associated speaker for transduction to acoustic energy.

The audio system may have circuitry for processing bass range frequencies, and may have a separate speaker for bass range frequencies. One example of circuitry for processing bass range frequencies is described in U.S. patent application Ser. No. 09/735,123.

Figure 5A:
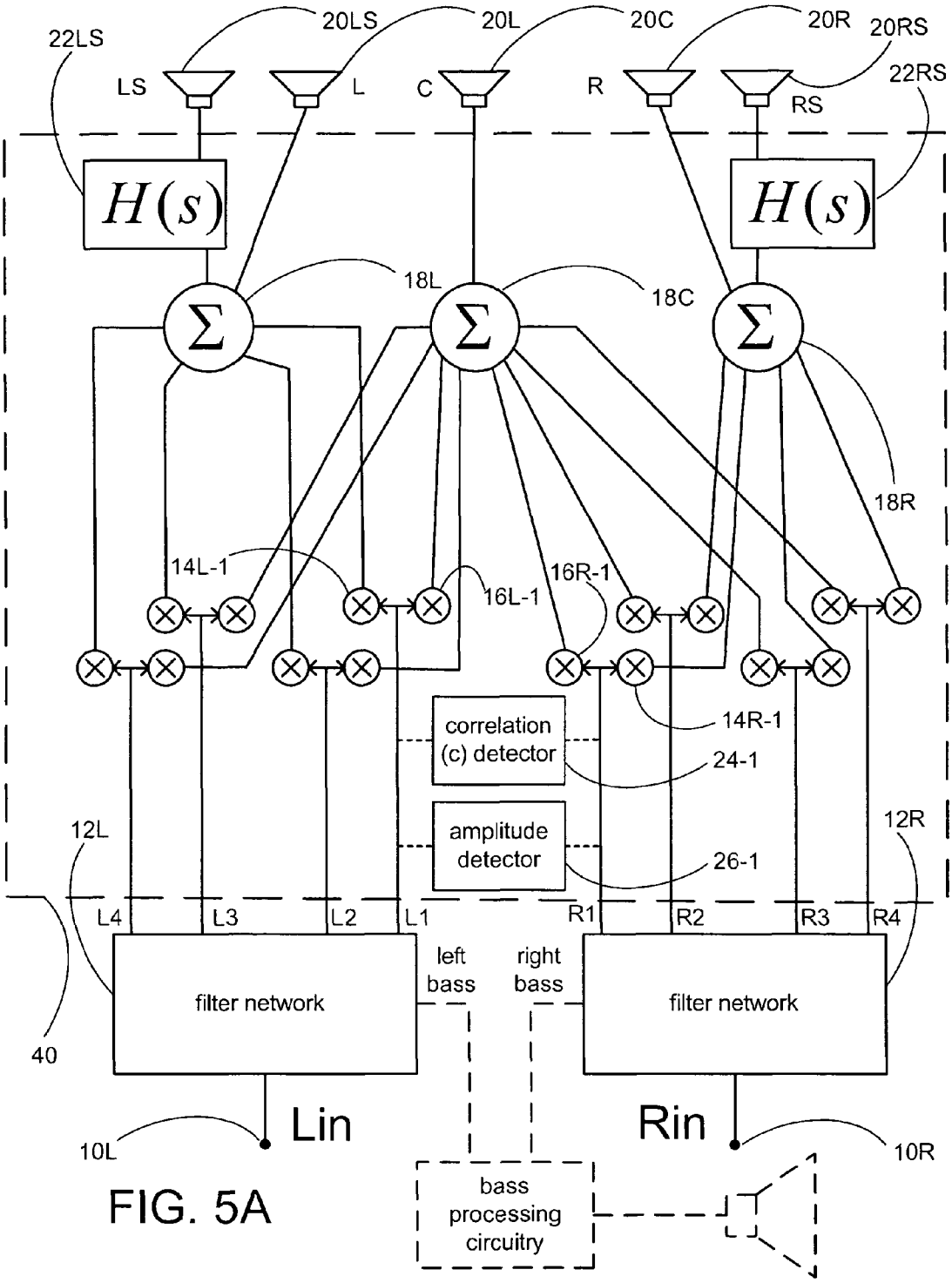
FIGS. 5A and 5B are block diagrams of audio systems showing implementations of the steering circuitry of FIG. 4.

Referring now to FIG. 5A, there is shown an implementation of the audio signal processing system of FIG. 4. In the implementation of FIG. 5A, the filter network has four output terminals for each of four spectral bands (L1, L2, L3, and L4, and R1, R2, R3, and R4, of the left and right channels, respectively). Each logic block includes an amplitude detector 24-1; a correlation detector 26-1; a scaling operator such as 14L-1 coupling an output terminal such as L1 to left summer 18L; a scaling operator such as 16L-1 coupling an output terminal such as L1 to center summer 18C; a scaling operator such as 14R-1 coupling an output terminal such as R1 to right summer 18R; and a scaling operator such as 16R-1 coupling an output terminal such as R1 to center summer 18C. Logic blocks for the other frequency bands have similar components, not shown in this view. Left summer 18L is communicatingly coupled to left speaker 20L and is communicatingly coupled through transfer function block 22LS to left surround speaker 20LS. Right summer 18R is communicatingly coupled to right speaker 20R and is communicatingly coupled through transfer function block 22RS to right surround speaker 20RS.

In operation, a left channel signal is received at input terminal 10L and split into frequency bands L1, L2, L3, and L4 and optionally a bass frequency band. A right channel signal is received at input terminal 10R and split into frequency bands R1, R2, R3, and R4 and optionally a bass frequency band. Each of left channel frequency bands L1, L2, L3, and L4 is processed with a corresponding right channel frequency band R1, R2, R3, and R4 respectively, by a correlation detector 24-1 and an amplitude detector 26-1. Amplitude detector 26-1 measures the amplitude of the left L1 band signal and the right R1 band signal, and provides information to scaling operators such as 14L-1 and 16L-1 as will be described later. Similar amplitude detectors not shown measure the amplitude of the corresponding L and R signal lines, such as L2/R2, L3/R3, and L4/R4.

The correlation detector 24-1 compares the signals on signal lines L1 and R1 and provides correlation coefficient $c_1$. Similar correlation detectors compare the signals on signals lines L2/R2, L3/R3, and L4/R4 and provide correlation coefficients $c_2$, $c_3$, and $c_4$. "Correlation" refers to the tendency of the signals to vary together over time. Correlation can be determined in a number of different ways. For example, in a simple form, two signals can be compared over a coincident period of time. Correlation could be the tendency of the two signals to vary together over that period of time. A typical interval of the coincident period of time is a few milliseconds. In a more sophisticated form of correlation detection the data may be smoothed to prevent aberrant conditions from unduly influencing the correlation calculation; or the tendency of the two signals to vary together may be measured over similar but non-concurrent intervals of time. So, for example, two signals that vary in the same way over time, but phase shifted or time delayed could be considered correlated. The amplitude and polarity of the signals may or may not be considered in determining con-elation. The simpler forms of determining correlation require less computational power than other forms, and for many situations produces results that are not audibly different than other forms. The degree of correlation is typically defined by a correlation coefficient c calculated according to a formula. Typically if the correlation coefficient calculation formula yields a result of zero or near zero, the signals are said to be uncorrelated. If the correlation coefficient calculation formula yields a result of one or near one, the signals are said to be correlated. Some correlation coefficient formula calculations may allow the correlation coefficient to have a negative value, so that a correlation coefficient of minus one indicates two signals that are correlated but out of phase (or in other words, tend to vary inversely to each other).

Scaling operator 16-1 scales the left lower frequency band signal by a factor related to the correlation coefficient $c_1$ and to the relative amplitudes of the signals on signal lines L1 and R1. The resultant signal is transmitted to summer 18C. Scaling operator 14-1 scales the L1 signal by a factor related to the coefficient CL and to the relative amplitudes of the signals in signal lines L1 and R1 and transmits the scaled signal to summer 18L. The R1 signal is scaled at scaling operator 16R-1 by a factor related to the correlation coefficient $c_1$ and to the relative amplitudes of the signals on L1 and R1 and transmitted to summer 18C. Scaling operator 14R-1 scales the R1 signal by a factor related to the coefficient $c_1$ and to the relative amplitudes of the signals in signal lines L1 and R1 and transmits the scaled signal to summer 18R. Specific examples of determination of scaling factors will be described below. Summers 18L, 18C, and 18R sum the signals that are transmitted to them and transmit the combined signal to speakers 20L, 20C, and 20R, respectively. The signal from summers 18L and 18R may also be processed by a transfer function and transmitted to speakers LS and RS, respectively. The values of the coefficients are calculated on a band by band basis, so that the values of coefficients may be different for frequency bands L1/R1, L2/R2, L3/R3, and L4/R4. Additionally the L1 coefficient may be different than the R1 coefficient, the L2 coefficient may be different than the R2 coefficient, and so on. The values of the coefficients may vary over time. The values of the break frequencies of the filters of the frequency bands may be fixed, or may be time varying based on some factor, such as correlation. The equations used to calculate the scaling factors may differ in different bands.

In one embodiment, speakers 20L, 20R, 20C, 20LS, and 20RS are satellite speakers in a subwoofer-satellite type audio system. The transfer functions 22LS and 22RS may include time delays, phase shifts, and attenuations. In other embodiments, transfer functions 22LS and 22RS may be time delays of different length, phase shifts, or amplifications/attenuations, or some combination of time delay, phase shift, and amplification, in either analog or digital form. In addition, other signal processing operations to simulate other acoustic room effects can be perfomed on the signals to speakers 20L, 20R, 20C, 20LS, and 20RS.

Figure 5B:
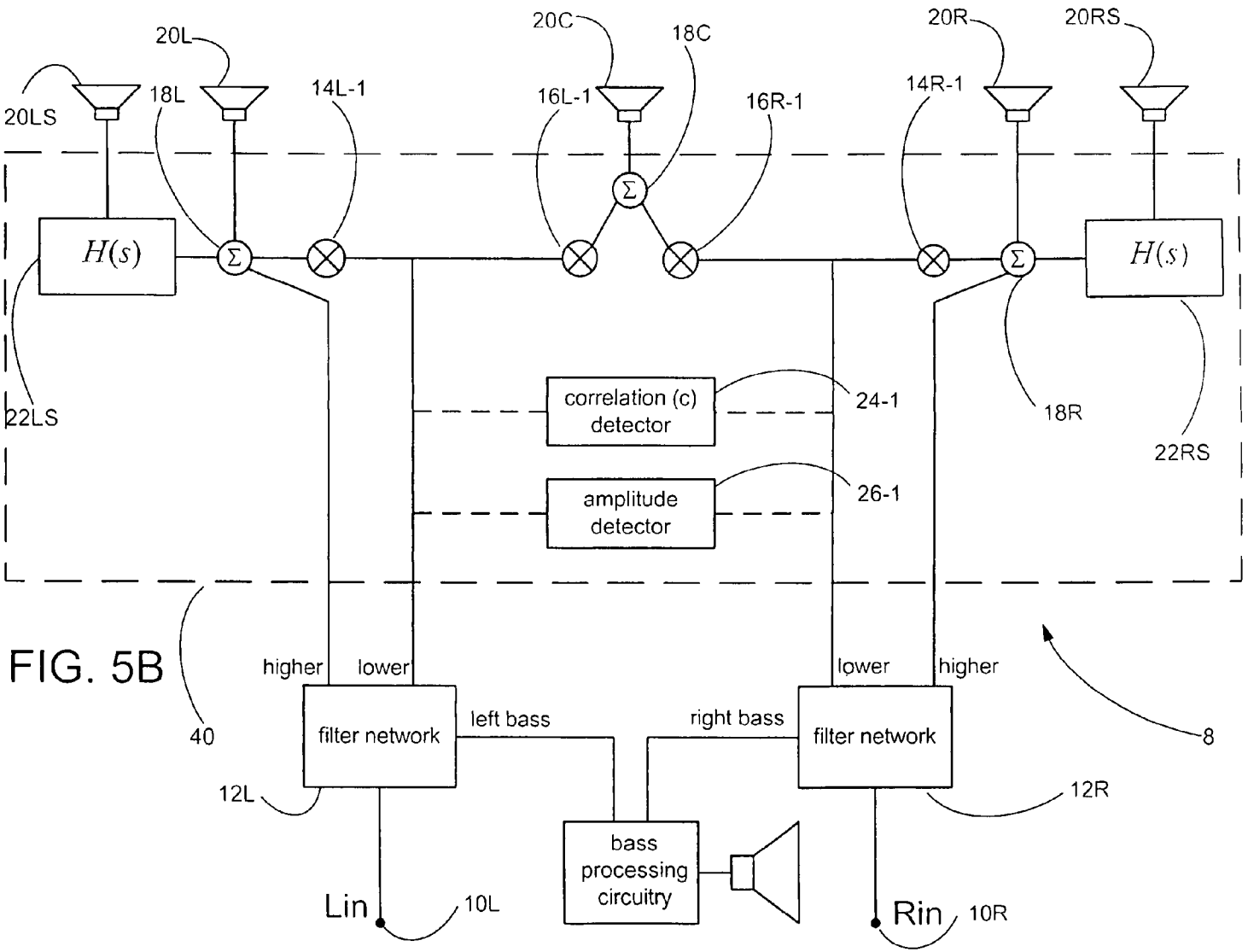

Referring now to FIG. 5B, there is shown an example of another audio system embodying elements of the audio system of FIG. 4. Left signal input terminal 10L is coupled to filter network 12L. Filter network 12L outputs three frequency bands: a bass frequency band, and two non-bass frequency bands, one of which is higher than the other and is referred to as a "higher" frequency band and correspondingly, one of which is lower than the other and is referred to as a "lower" frequency band. For example, the "lower" band could be from the speech band (for example 20 Hz to 4 kHz) and the "higher" band could be frequencies above the speech band. The output terminal for the bass frequency band is coupled to bass processing circuitry. The lower non-bass frequency terminals of filter network 12L is coupled to scaling operators 14L-1 and 16L-1. The output terminal of scaling operator 16L-1 is coupled to summer 18C. The output terminal of scaling operator 14L-1 is coupled to summer 18L. The higher non-bass frequency output terminal of filter network 12L is coupled to summer 18L. The output terminal of summer 18L is coupled to speaker 20L and through transfer function 22LS, which in this case is a time delay of 8 ms and a 3 dB attenuation, to speaker 20LS. Right signal input terminal 10R is coupled to filter network 12R. Filter network 12R outputs three frequency bands similar to the frequency bands output by filter network 12L. The output terminal for the bass frequency band is coupled to bass processing circuitry. The lower non-bass frequency terminals of filter network 12R is coupled to scaling operators 14R-1 and 16R-1. The output terminal of scaling operator 16R-1 is coupled to summer 18C. The output terminal of scaling operator 14R-1 is coupled to summer 18R. The higher non-bass frequency output terminal of filter network 12R is coupled to summer 18R. The output terminal of summer 18R is coupled to speaker 20R and through transfer function 22RS, which in this case is a time delay of 8 ms and a 3 dB attenuation, to speaker 20RS. Amplitude detector 26-1 and correlation detector 24-1 are coupled to the left lower frequency band filter network output terminal and the right lower frequency band filter output terminal so that they can measure and compare the amplitudes and determine correlation of the left lower signal and the right lower signal as to provide information to the scaling operators to for the calculation of scaling factors. The use of rms values for taking into account the relative amplitudes of the signals is convenient, but other amplitude measures, such as peak or average values can be used.

In one implementation, amplitude detector 26-1 measures the amplitude of the signal of the left lower frequency band signal and the amplitude of the signal of the right lower frequency band signal and provides amplitude information to the scaling operators associated with the frequency band, in this case scaling operators 14L-1, 16L-1, 14R-1, and 16R-1. The correlation detector 24-1 compares the signals in the left and right lower frequency band and provides a correlation coefficient $$c_L = \frac{X_L - \sqrt{L_L^2 + R_L^2}}{L_L + R_L - \sqrt{L_L^2 + R_L^2}},$$

where $L_L$ and $R_L$ are the rms values of L and R of the lower frequency band over a time period, and X is the greater of the rms values of (L+R) or (L−R) over a period of time. Correlation coefficient $C_L$ can have a value of 0 to 1, with 0 indicating perfectly uncorrelated and 1 indicating correlated; in this implementation, phase is not considered in calculating the correlation coefficient. The "L" subscript indicates that the correlation coefficient is for the lower non-bass frequency band. Scaling operator 16L-1 scales the left lower frequency band signal by a factor $$a(\text{left})_L = \frac{(LPR_L - c_L L_L - ((1 - c_L)Y))}{Y}$$

where $LPR_L$ is the rms value of (L+R) or (L−R) over a period of time, and Y is the greater of $LPR_L$ and $LMR_L$, where $LMR_L$ is the rms value of (L−R) over a period of time. Scaling operator 14L-1 scales the left lower frequency band signal by a factor $\sqrt{1-a(\text{left})_L^2}$. Scaling operator 16R-1 scales the right lower frequency band signal by a factor $$a(\text{right})_L = \frac{(LPR_L - c_L R_L - ((1 - c_L)Y))}{T}),$$

which may be different than $a(\text{right})_L$. Scaling operator 14R-1 scales the left lower frequency band signal by a factor $\sqrt{1-a(\text{right})_L^2}$.

The left higher frequency band output is coupled directly to summer 18L so that the audio signal to speaker 20L consists of the left higher frequency band output from filter network 12L and the output from scaling operator 14L-1. The right higher frequency band output is coupled directly to summer 18R so that the audio signal to speaker 20R consists of the right higher frequency band output from filter network 1-2R and the output from scaling operator 14R-1.

Scaling the portion of the L and R signals contributed to the center channel by a factor a and scaling the portion of the L and R signals that remains in the L and R channels, respectively, by a factor $\sqrt{1-a^2}$ results essentially in a conservation of energy routed to the center speaker and the left and right speakers. If the scaling results in a very strong center speaker signal, the L and R signals will be correspondingly significantly less strong. If the L and R signals (and not an L−R signal) are processed to provide the left surround speaker and the right surround speaker signals, respectively, then the left surround speaker signal and the right surround speaker signal will be less strong than the center speaker signal. This relationship results in a center acoustic image that remains firmly anchored in the center and in the front. If the scaling results in a weak center speaker signal, the L and R signals will be correspondingly significantly stronger. If the L and R signals (and not an L−R signal) are processed to provide the left surround speaker and the right surround speaker signals, respectively, then the left surround speaker signal and the right surround speaker signal will be stronger than the center speaker signal. This relationship results in a spacious acoustical image when there is no strong central acoustic image.

Referring now to FIG. 6, there are shown plots of the behavior of the lower non-bass frequency band according to the exemplary steering circuitry 40 described in FIG. 5B for various combinations of correlation and relative amplitudes.

Figure 6A:
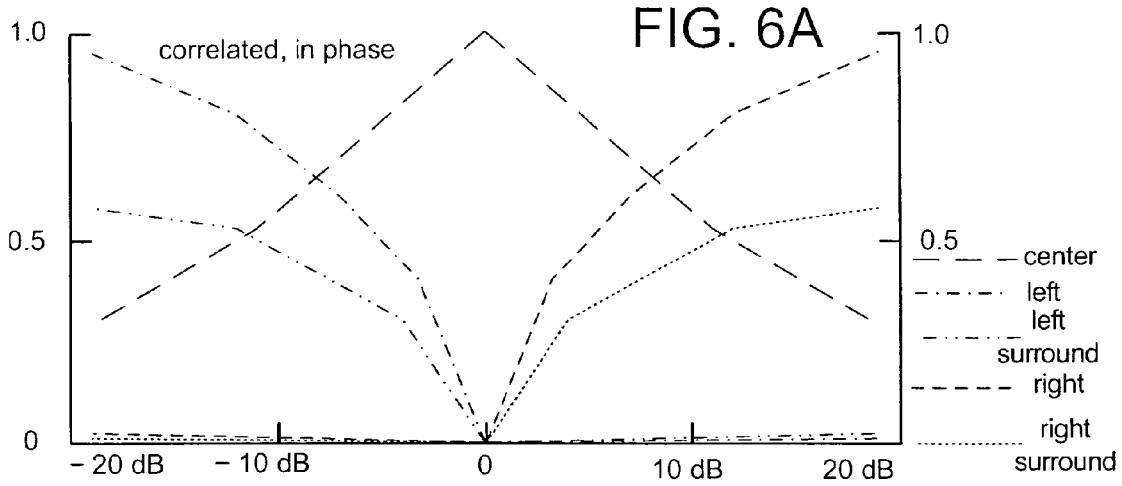
FIGS. 6A-6C are plots showing the behavior of a first steering circuit.
Figure 6B:
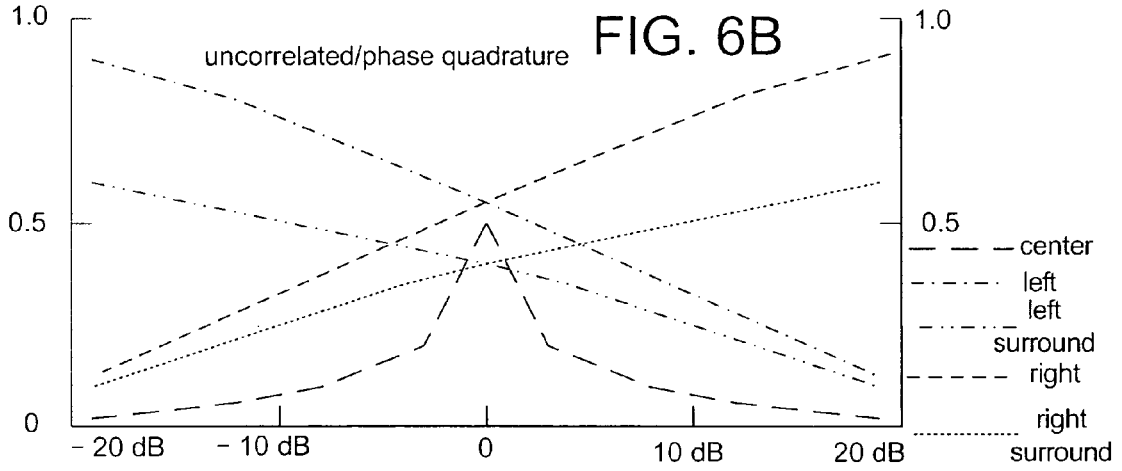
Figure 6C:
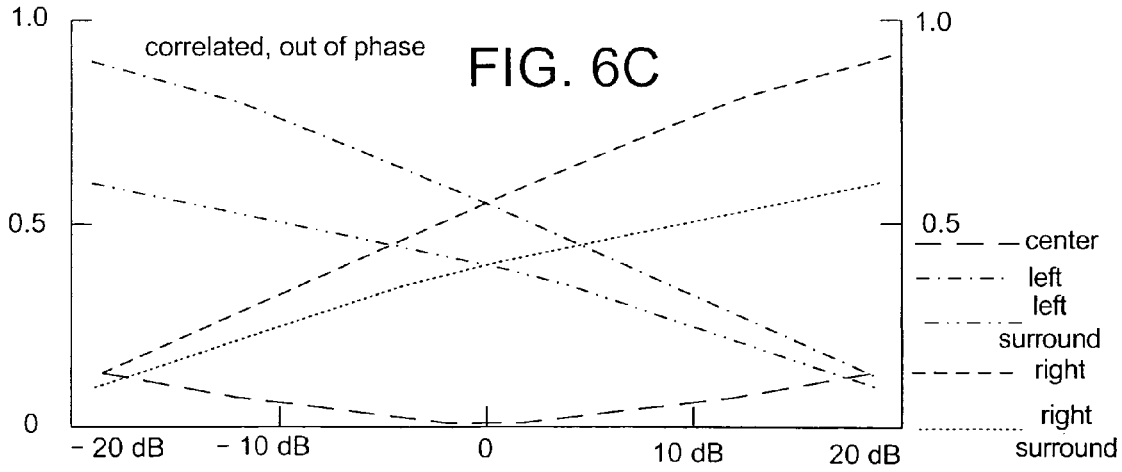

The left side of each plot represents the steering behavior of the exemplary steering circuit for one or more spectral bands if the amplitude of the signal in the right channel (for example channel R1 of FIG. 2) is significantly lower (for example −20 dB) relative to the signal in the left channel (for example channel L1 of FIG. 2), or in other words if the amplitude of the signal in the left channel is significantly greater than the amplitude of the signal in the right channel (a condition hereinafter referred to as "left weighted"). The right side of each plot represents the steering behavior of the exemplary steering circuit for one or more spectral bands if the amplitude of the signal in the right channel (for example channel R1 of FIG. 2) is significantly greater (for example, +20 dB) relative to the signal in the left channel (for example channel L1 of FIG. 2), a condition hereinafter referred to as "right weighted". The middle portion of each plot is the behavior of the exemplary steering circuit if the amplitudes of the left channel and the right channel are substantially equal. The behavior of the steering circuitry is expressed in terms of the scaling factor applied to the various signals. The behavior of the exemplary steering circuitry is shown for three conditions: FIG. 6A shows the effect of the steering circuitry when the signals in the left and right channels are correlated and in phase (typically indicated by a correlation coefficient c of 1). FIG. 6B shows the effect of the steering circuitry when the signals in the left and right channels are uncorrelated (typically indicated by a correlation coefficient c of 0 or if the signals in the left and right channels are in phase quadrature. In other examples of steering circuitry, the behavior in uncorrelated and phase quadrature conditions could be different. FIG. 6C shows the effect of the exemplary steering circuit if the signals in the left and right channels are correlated and out of phase (i.e. vary inversely with each other).

The plots are intended to illustrate general behavior and are not intended to be used for providing precise data. FIGS. 6 and 7 show the behavior of the steering circuit for cardinal values of the correlation coefficient c. For other values of c, the curves will differ from FIGS. 6 and 7.

It can be seen in FIG. 6A if the signals in the left and right channels are correlated (c=1), and if the signals are left weighted, the right speaker signal and the right surround speaker signal, are scaled by a factor near zero. The left speaker signal is scaled by a factor about 1.0. The left surround speaker is scaled by a factor of about 0.5. Similarly, if the amplitudes of the signals are right weighted, the left speaker signal and the left surround speaker signal are scaled by a factor near zero. The right speaker signal is scaled value of about 1.0. The right surround speaker signal is scaled by a factor of about 0.5. For situations in which the amplitudes of the signals in the left and right channels are approximately equal, the center speaker signal is scaled by a factor of about 1.0 and the signals to the other speakers are scaled by a factor of near zero.

Looking at the curves corresponding to the individual speakers in FIG. 6A, for left and right weighted conditions, the center speaker signal is scaled by a factor of approximately 0.3. As the amplitudes become less left or right weighted, the scaling factor increases so that when the amplitudes of the signals in the left and right input channels are equal, the scaling factor of center speaker signal is about 1.0. For a left weighted condition, the scaling factor of the left speaker signal is about 0.9. As the amplitude becomes less left weighted, the scaling factor of the left speaker signal decreases, until it becomes approximately 0 when the amplitudes of the signals in the left and right channels are equal, and remains approximately zero for all values in which the signal in the right input channel is greater than the signal in the left input channel. For a left weighted condition, the scaling factor of the left surround speaker signal is approximately 0.6. As the amplitudes becomes less left weighted, the scaling factor of the left surround speaker signal decreases, until it becomes approximately zero when the amplitudes of the signals in the left and right channels are equal, and remains approximately zero for all values in which the signal in the right input channel is greater than the signal in the left input channel. The effect of the exemplary steering circuitry of FIG. 6A on the right and right surround channels is substantially a mirror image of the effect on the left and left surround channels.

It can be seen in FIG. 6B (c=0) that if the signals in the two channels are uncorrelated or in phase quadrature, for a left weighted condition, the left surround speaker signal has the highest scaling factor and the left surround speaker signal has the next highest weighted value. The right, right surround and center speaker signals have a relatively low scaling factor. For a right weighted condition, the signals show a substantially mirror image relationship. For situations in which the amplitudes of the signals in the left and right channels are substantially equal, the scaling factors to all five speakers are in a relatively narrow band, with the left/right speaker signals having a slightly larger scaling factor than the center speaker signal, and the center speaker signal having a slightly higher value that the left surround speaker signal and right surround speaker signal.

The plot of FIG. 6C, in which the L and R signals are correlated (c=1) and out of phase, shows the behavior of the steering circuitry relative to the left, left surround, right, and right surround speakers is similar to the behavior shown in FIG. 6B. However, in the curve of FIG. 6C, the center speaker signal has a low scaling factor under all conditions, and decreases to substantially zero if the signals in the input channels have the same amplitude.

Figure 7A:
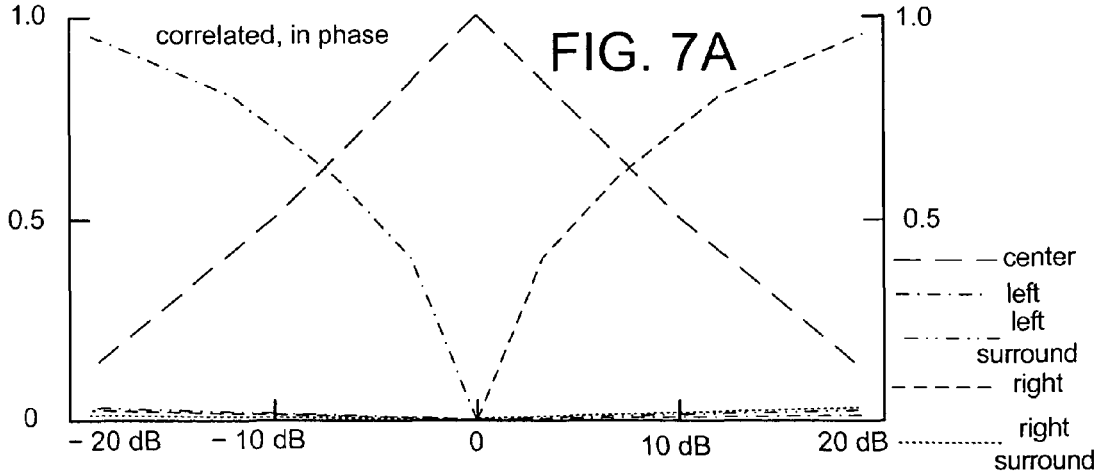
FIGS. 7A-7C are plots showing the behavior of a second steering circuit.

FIG. 7 discloses the behavior of another exemplary steering circuitry. The behavior shown in FIG. 7A (c=1) is similar to the behavior shown in FIG. 6A for the left, right, and center speaker signals. The scaling factor for the left surround and right surround speaker signals is substantially zero for all amplitude relationships of the input signals, indicating that the scaling factors are substantially independent of the amplitude relationships of the input channels. The behavior shown in FIG. 6A and FIG. 7A is substantially the same for situations in which the amplitude of the signals in the two input channels is the same, which is consistent with an assumption that when signals are correlated, in phase, and of equal amplitude, the source of the sound is desired by the creator of the audio source material to be localized between the left and right speakers.

Figure 7B:
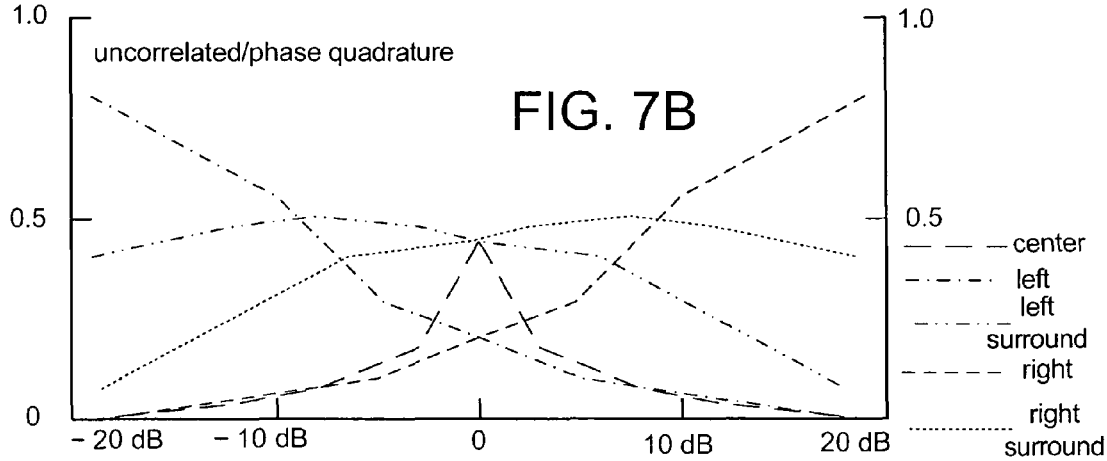

A difference between the behavior shown in FIG. 7B (c=0) and the behavior shown in FIG. 6B is that at certain amplitude relationships, in this example when the amplitudes of the signals in the two channels differ by less than 10 dB, in FIG. 7B the scaling factors of the surround speaker signals are greater than the scaling factors of the left and right speaker signals. Unlike the behavior of FIG. 6B, the behavior shown in FIG. 7B provides for a situation (uncorrelated, amplitudes relatively equal) in which the surround speaker scaling factors are larger than the left and right speaker scaling factors, therefore causing the audio image to move toward the rear.

Figure 7C:
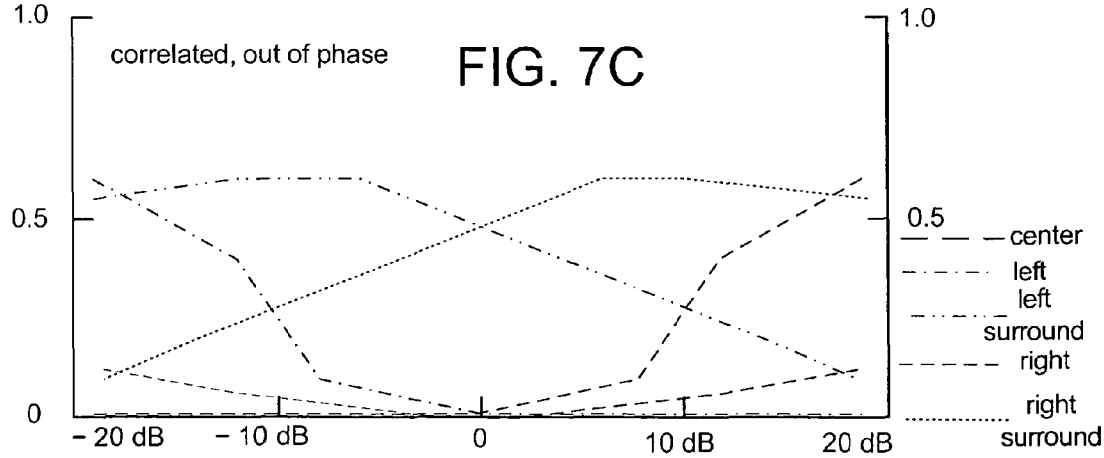

A difference between the behavior shown in FIG. 7C (c=1, out of phase) and the behavior shown in FIG. 6C is that at most points on the plot, the scaling factor applied to the surround speaker signals (for example, the left surround speaker) is significantly greater than the scaling factor applied to the corresponding front speaker (for example the left speaker). This is consistent with audio encoding systems in which surround information is encoded as out of phase correlated audio signals.

Audio systems of the type shown in FIG. 1A using steering circuitry 40 of the type disclosed in FIG. 4 are advantageous over conventional audio systems that process stereo channel signals to provide x channel signals. Conventional audio systems that process an L−R signal to provide surround channels from conventionally create stereo material may result in undesirable audible effects. For example, a stereo recording of a sound source located equidistant from two stereo microphones may include direct radiation from the source that is highly correlated, but reverberant radiation that is not highly correlated because of acoustical asymmetries in the environment in which the recording was made. The uncorrelated reverberations may contribute to an L−R signal. A conventional audio system that generates an L−R signal to use as a surround signal may then cause the reverberations to be reproduced in a manner that sounds unnatural relative to the direct radiation. Audio systems of the type shown in FIG. 1A using the steering circuitry 40 of the type disclosed in FIG. 4 are also advantageous over audio systems that do not process signal in multiple frequency bands because they do not acoustic events in one frequency band to unnaturally affect acoustic events in other frequency bands. For example, if an acoustic source in the vocal range is intended to be in the center, and instrumental acoustic sources outside the vocal range are intended to be on the sides, the vocal range acoustic source does not cause the instrumental range acoustic source to tend to appear to come from the center, and the instrumental range acoustic source does not cause the vocal range acoustic source to tend to appear to come from the sides.

Audio systems of the type shown in FIG. 1B using steering circuitry 40 of the type disclosed in FIG. 4 are advantageous over conventional audio systems that decompress two channel compressed audio signal data because they do not form a difference signal of the de-compressed L and R signals. Therefore systems using the circuitry 40 of FIG. 4 unmask artifacts or misinterpret differences between de-compressed L and R channel signals to a much lesser extent than do conventional audio systems that generate and process the L−R signal to provide additional channels. If the uncompressed audio signals are conventionally created stereo signals, audio systems of the type shown in FIG. 1B are also advantageous for the reasons stated in connection with the audio systems of the type shown in FIG. 1A.

Those skilled in the art may now make numerous uses of and departures from the specific apparatus and techniques disclosed herein without departing from the inventive concepts. Consequently, the invention is to be construed as embracing each and every novel feature and novel combination of features disclosed herein and limited only by the spirit and scope of the appended claims.

What is claimed is:

1. A method for processing audio signals, the method comprising:

separating audio signal data that were previously compressed by an unknown compression technique in two input audio channels into frequency bands;

separately processing the frequency bands; and combining the separately processed frequency bands to provide n output audio channels, where n>2.

2. A method for processing audio signals in accordance with claim 1, wherein the separately processing the frequency bands includes scaling a first channel first frequency band signal, scaling a second channel first frequency band signal, and wherein the separately processing does not include processing a signal representing the difference between any portions of the audio signals in the two input audio channels.

3. Apparatus for processing audio signals in at least two input audio channels to provide more than two output audio channels, the apparatus comprising:

circuitry for separating audio signal data that were previously compressed by an unknown compression technique in the input audio channel signals into frequency bands;

circuitry for separately processing the frequency bands; and circuitry for combining the separately processed frequency bands to provide the more than two output audio channels.

* * * * *